US005527088A

United States Patent [19]

MacLean

[11] Patent Number: 5,527,088

[45] Date of Patent: Jun. 18, 1996

[54] COMBINATION BACKPACK AND CHAIR

[76] Inventor: Shian MacLean, 7027 Dublin Blvd., Dublin, Calif. 94568

[21] Appl. No.: 392,148

[22] Filed: Feb. 22, 1995

[51] Int. Cl.[6] ..... A47C 13/00; A45F 4/02

[52] U.S. Cl. ..... 297/129; 224/155

[58] Field of Search ..... 297/39, 129; 224/155

[56] References Cited

U.S. PATENT DOCUMENTS

| | | | |
|---|---|---|---|
| 3,250,449 | 5/1966 | Woodman | 224/9 |
| 4,487,345 | 12/1984 | Pierce et al. | 224/155 |
| 4,582,165 | 4/1986 | Latini | 224/155 |
| 4,676,548 | 6/1987 | Bradbury | 297/129 |
| 4,720,029 | 1/1988 | Varanakis | 224/155 |
| 4,747,526 | 5/1988 | Launes | 224/155 |
| 4,762,256 | 8/1988 | Whitaker | 224/155 X |
| 5,297,708 | 3/1994 | Carpenter | 224/155 |
| 5,318,342 | 6/1994 | Hale | 297/129 |
| 5,381,941 | 1/1995 | Brune | 224/155 |

FOREIGN PATENT DOCUMENTS

| | | | |
|---|---|---|---|
| 1469054 | 3/1977 | United Kingdom | 297/129 |

*Primary Examiner*—Peter R. Brown

[57] ABSTRACT

A pack frame that is convertible to a chair, having a generally rectangular shaped back section which has fittings that allow a back pack to be attached to it, and a generally rectangular shaped seat section pivotally connected to the back section. The back and seat sections have fabric or plastic panels attached to each respectively that form the back and seat of the chair. Two adjustable shoulder straps are each attached at one end to the front of the chair seat and at the other end to the lower portion of the rear leg member of the chair. When the invention is folded into position for use as a pack frame, the member that forms the front of the chair seat pivots and hooks or latches into the back of the chair, locking the device into a rigid pack frame, and retaining clips hold the front and rear legs together. All horizontal cross members are shaped to curve away from the user's body when the invention is used as a pack frame, for the comfort of the user. The invention is designed to be used with a padded hipbelt and ventilated backpad for the user's comfort. A second embodiment of the combination pack and chair in which a rigid backpack is attached to the back of a chair, so that when the combination pack and chair is carried on a person's back, the chair is held away from the person's back so it will not rub or bump the user's body. A third embodiment of the combination pack and chair in which a rigid backpack is attached to the underside of a folding chair, so that when the combination pack and chair is carried on a person's back, the folding chair is held away from the person's back and will not rub or bump against the user's body.

9 Claims, 5 Drawing Sheets

COMBINATION BACKPACK AND CHAIR

BACKGROUND—FIELD OF INVENTION

This invention relates to a combination backpack and chair.

BACKGROUND—DESCRIPTION OF PRIOR ART

Backpacks are used to distribute the weight of a pack and its contents comfortably to the user's shoulders, back and hips. A pack frame distributes the weight and also allows ventilation between the pack and the user's back and shoulders, which contributes to the comfort of the user.

Backpacks and pack frames are designed to be lightweight and strong and to distribute the load comfortably by means of attached padded shoulder straps, padded hip belts, and metal frame members that are designed to curve around the user's neck, back and hips so that the metal pack frame members do not rub against the user's backbone, neck, hips or shoulders. Pack frames are fitted with ventilated mesh fabric pads that will come in contact with the user's back so that the user has ventilation between the pack frame and the user's back.

Packs that are used without an external frame are designed to fit comfortably against the user's back and may have a rigid or semi-rigid internal frame to provide a smooth panel on the side of the pack that is in contact with the user's back. This panel may also be padded for comfort.

Folding chairs, usually made of aluminum tubing or other lightweight metal tubing, with fabric or vinyl seats and backs are also designed to be lightweight, strong and comfortable.

Devices of prior art consisting of back packs or back pack frames that convert to a folding chair have resulted in compromises that are either not comfortable or practical when used as a backpack or pack frame, or not comfortable or practical when used as a chair, or not comfortable or practical in either usage.

For example, U.S. Pat. No. 4,676,548 to Bradbury (1987) and U.S. Pat. No. 4,487,345 to Pierce and Merrill (1984) each present a combination folding chair and backpack which when folded into position to be used as a backpack, has tubular metal or wooden members, including the bottom of the chair legs and the front of the chair seat, that will rub uncomfortably against the user's backbone, neck and hips.

The above mentioned prior art devices are not designed to include metal parts that curve around the user's back, neck and hips. They are also not designed to be used with padded hipbelts and ventilated back pads in order to make them comfortable to use as back packs.

Furthermore the above mentioned prior art devices have not solved the problem of shaping the front part of the chair seat and the bottom section of the chair legs and other cross pieces that connect the left and right sides-of the chair so that they avoid rubbing the user's backbone, neck and hips when the device is in use as a backpack, yet provide comfortable and practical support when in use as a chair.

The above mentioned prior art devices have not solved the problem of designing a device that will lock up into a rigid frame when it is to be used as a back pack frame and yet is easily unfolded into a chair. U.S. Pat. No. 4,676,548 to Bradbury (1987) describes a device that has to be fastened together with two separate pairs;of straps that connect the tubular member forming the top of the chair back and the tubular member forming the front of the chair seat, and each pair of straps has to be fastened together by means of buckles.

The above mentioned prior art devices have the appearance of being uncomfortable and awkward to use as pack frames or back packs, and therefore do not have commercial appeal.

The invention described in U.S. Pat. No. 4,676,548 to Bradbury (1987) has a number of disadvantages:

(a) The member that forms the bottom of the front legs will rub against the user's hips or backbone when used as a pack frame.

(b) The member that forms the front of the seat will rub against the backbone, neck or shoulders of the user when used as a pack frame.

(c) When folded up into a backpack the invention does not lock together easily into a rigid pack frame. The user would have to manually fasten two sets of straps together to hold the device in position as a backpack.

(d) The invention does not unfold into a full size chair that would be comfortable for the average adult, but instead has very short legs and is not high enough to be comfortable.

(e) It requires a low back so that when the device is folded into position as a chair, the top of the back and the front of the seat will be adjacent to each other so that they can be fastened together by means of straps.

(f) It has no padded hipbelts or ventilated backpad to provide comfortable support when used as a backpack.

OBJECTS AND ADVANTAGES

Accordingly, several objects and advantages of my invention are:

(a) to provide a combination backpack and chair that is comfortable for use as a backpack and also comfortable for use as a chair;

(b) to provide a combination backpack and chair that locks together easily into a rigid frame when folded up;

(c) to provide a combination backpack and chair that has all the comfortable features of a well-designed backpack or pack frame, including "anatomical" design with cross-pieces shaped to curve away from the user's back, Shoulders and neck for comfort, and padded hip belt and shoulder straps and ventilated back pad;

(d) to provide a combination backpack and chair, which when used as a chair, is sturdy and comfortable and can be used on most types of terrain, including sand or soft ground;

(e) to provide a combination backpack and chair which when used as a chair will hold an attached pack in an upright position for convenient access to the pack;

(f) to provide a combination backpack and chair that can be manufactured easily and economically;

(g) to provide a packframe that will support a variety of types and sizes of backpacks and that can also be used to carry additional loads because of the design of the back section and the rear leg section;

(h) to provide a combination pack frame and chair which has the appearance of a pack frame when it is folded into position to be used as a pack frame, so that it will be obvious to a person looking at the invention that it will be comfortable in use as a pack frame, and thus will have commercial appeal;

(i) to provide a chair that can be folded up and carried on a person's back, with no additional backpack being attached to it;

(j) to provide a combination backpack and chair that is greatly improved over any previously disclosed combination backpack and chair by combining all of the following elements for the comfort and convenience of the user: back, seat and leg cross members that are designed to curve away from the user's back, shoulders and hips when the combination backpack and chair is carried as a backpack; a front cross member of the seat that pivots away from the user's back when the combination backpack and chair is carried as a backpack, and also pivots away from the user's legs when the combination backpack and chair is used as a chair; padded shoulder straps that are positioned for comfort; a padded hipbelt to help support the weight of the backpack and its contents; a ventilated back pad; a combination backpack and chair designed to hook or latch easily into a compact folded position so that it will not unfold while being used as a backpack; and a combination packback and chair that will support a heavy pack upright for the convenience of the user when it is in the chair position;

(k) to provide a combination backpack and chair with a backpack being constructed of a rigid shell which serves to hold the attached chair away from the user's back so that the attached chair will not rub or bump against the user's back when the combination backpack and chair is being carried as a backpack;

(l) to provide a combination backpack and chair with a rigid shell packback that can be constructed so that the back of the chair is an integral part of the backpack, and one side of the backpack forms the back of the chair, or alternately, a backpack that is constructed so that the seat of the chair is an integral part of the backpack and one side of the backpack forms the seat of the chair;

(m) to provide a combination backpack and chair that can be constructed with a backpack that has a rigid frame covered with a flexible material, where one side of the backpack also forms the back of the chair; or alternately, a backpack that has a rigid frame covered with a flexible material, where one side of the backpack also forms the seat of the chair.

Other objects and advantages of the present invention will become apparent from a consideration of the drawings and ensuing description.

REFERENCE NUMBERS IN DRAWINGS

Figure 1:
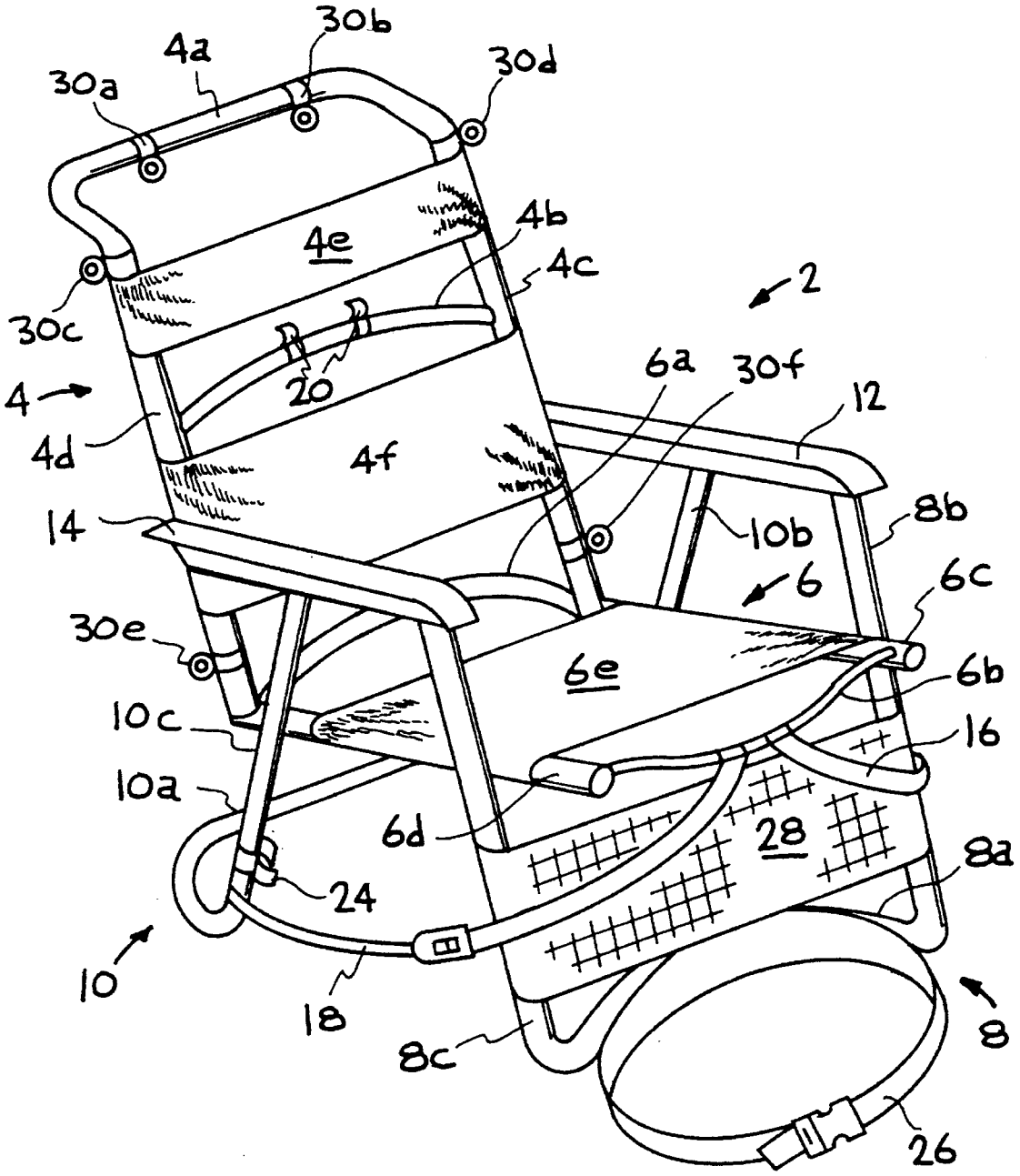
FIG. 1 is the combination pack frame and chair shown in the position to be used as a chair.

2 Frame of the combination packframe and chair
4 back section
**4*a*** back top cross member
**4*b*** back reinforcement member
**4*c*** left back member
**4*d*** right back member
**4*e*** back panel
**4*f*** back panel
6 seat section
**6*a*** seat rear cross member
**6*b*** seat front cross member (pivoting member)
**6*c*** left seat member
**6*d*** right seat member
**6*e*** seat panel
8 U-shaped front leg member
**8*a*** front leg cross member
**8*b*** left front leg member
**8*c*** right front leg member
10 U-shaped rear leg member
**10*a*** rear leg cross member
**10*b*** left rear leg member
**10*c*** right rear leg member
12 left armrest
14 right armrest
16 left shoulder strap
18 right shoulder strap
20 quick release hooks
22 left leg retaining clips
24 right leg retaining clips
26 padded hipbelt
28 ventilated back pad
**30*a*, 30*b*, 30*c*, 30*d*, 30*e*, 30*f*** backpack attachment fasteners
31 rigid pack
32 padded rigid panel
33 top access opening in pack.
34 side access opening in pack

Figure 2:
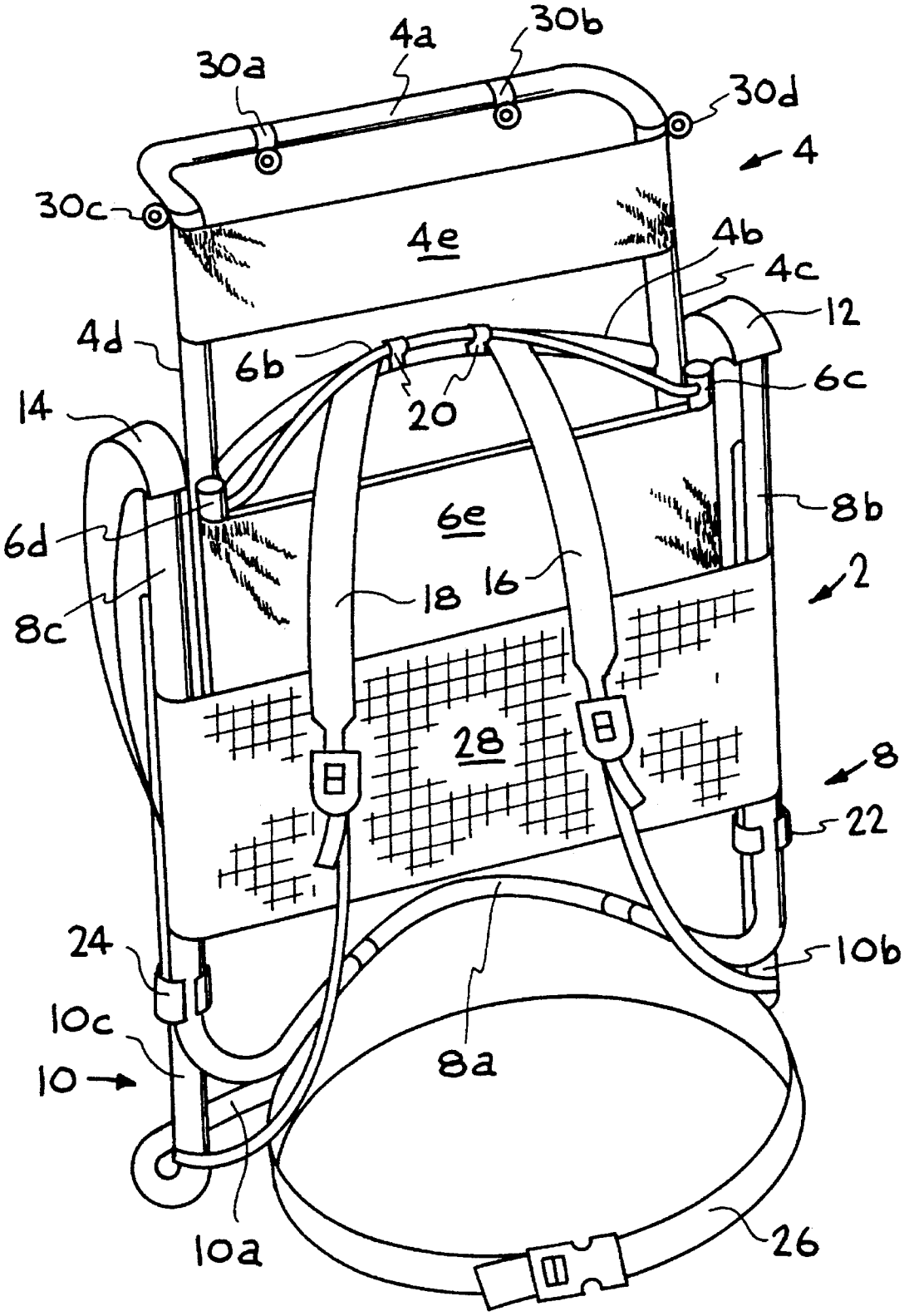
FIG. 2 the combination pack frame and chair shown in the position as a packframe.
Figure 3:
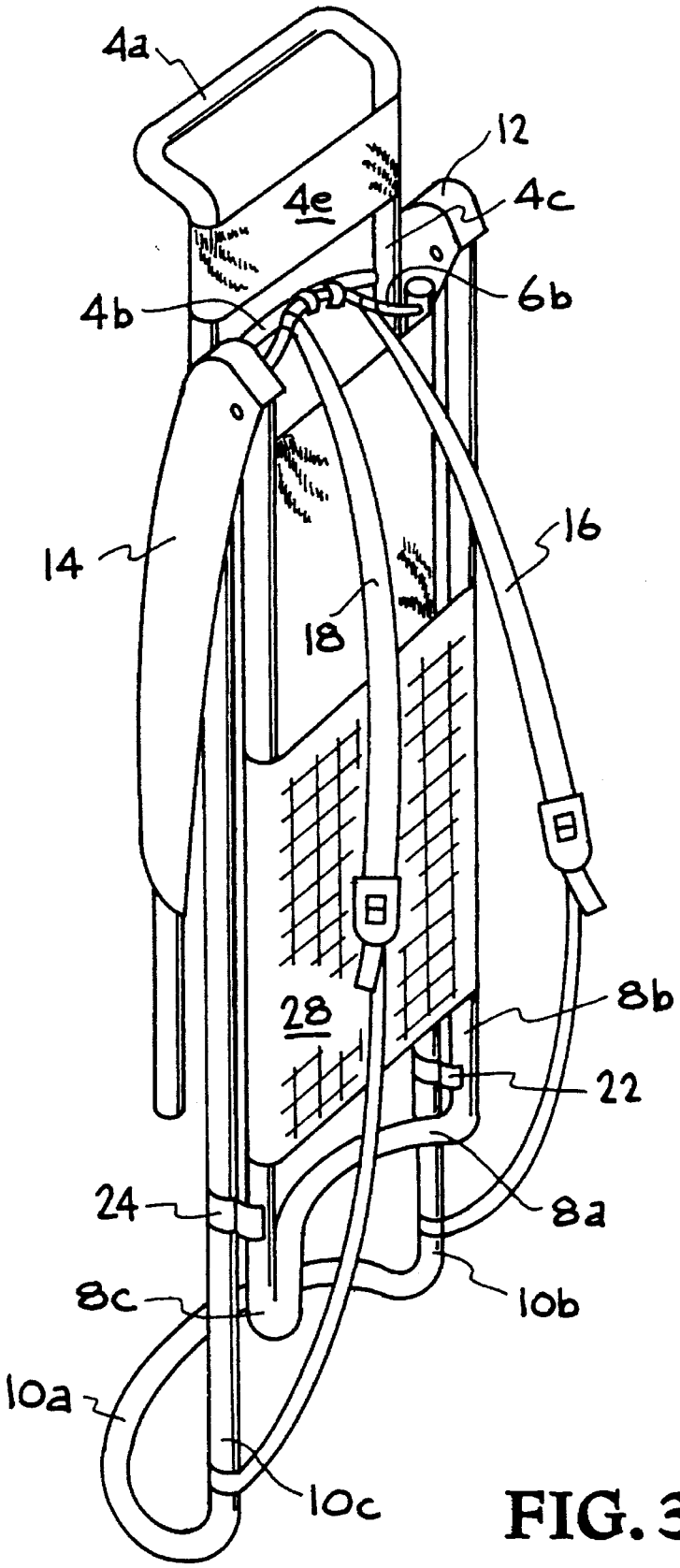
FIG. 3 is the combination pack frame and chair shown in the packframe position from a side view, shown without the hipbelt or backpack attachment fasteners.

Description—FIGS. 1, 2 and 3

The preferred embodiment of the present invention is illustrated in FIGS. 1, 2 and 3.

FIG. 1 shows the combination packframe and folding chair in the chair position. Frame 2 may be constructed of any light weight metal or plastic members that form a generally rectangular shaped back section 4 and a generally rectangular seat section 6 that are pivotally connected to each other.

Back section 4 consists of a back top cross member **4*a*, a back reinforcement member 4*b*, a left back member 4*c*, a right back member 4*d* and back panels 4*e* and 4*f***. Back members may be constructed from lightweight tubular metal and back panels may be constructed from fabric or plastic.

Seat section 6 consists of a seat rear cross member **6*a*, a seat front cross member 6*b*, a left seat member 6*c*, a right seat member 6*d*, and a seat panel 6*e*. Seat rear cross member 6*a*, left seat member 6*c* and right seat member 6*d* may be constructed from lightweight tubular metal, seat front cross member 6*b* may be constructed from a solid metal rod, and seat panel 6*e*** may be constructed from fabric or plastic.

Attached to seat section 6 are a U-shaped front leg member 8 and a U-shaped rear leg member 10. Front leg member 8 consists of a front leg cross member **8*a*, a left front leg member 8*b*, and a right front leg member 8*c*. Rear leg member 10 consists of a rear leg cross member 10*a*, a left rear leg member 10*b*, and a right rear leg member 10*c*. All leg members may be constructed of lightweight tubular metal. Front leg member 8 and rear leg member 10 are each pivotally connected to seat section 6. Armrests 12 and 14 are pivotally connected to the ends of leg members 8 and 10 and to left back member 4***c* and right back member 4*d* respectively.

All horizontal cross members of the invention, including back top cross member 4*a*, back reinforcement member 4*b*, seat rear cross member 6*a*, seat front cross member 6*b*, front leg cross member 8*a* and rear leg cross member 10*a*, are shaped so that they curve away from the user's neck, back, shoulders and hips when the combination packframe and chair is used as a pack frame. Rear leg cross member 10*a* is shaped so that it extends to the rear sufficiently so that when used as a chair the combination packframe and chair will support a pack and its contents attached to back section 4, without falling over. The extension of rear leg cross member 10*a* also allows the pack frame to support additional loads in addition to a pack, as the additional loads may be attached to rear leg cross member 10*a* when the invention is used as a pack frame.

Adjustable shoulder straps 16 and 18 are attached at one end to seat front cross member 6*b* and at the other end to left rear leg member 10*b* and right rear leg member 10*c* respectively.

FIG. 2 and FIG. 3 show the combination packframe and folding chair in the packframe position. When the combination pack frame and folding chair is used as a pack frame, seat front cross member 6*b* may be pivoted approximately 180 degrees and fastened to back reinforcement member 4*b* by means of quick release hooks 20 which hold seat front cross member 6*b* securely to back reinforcement cross member 4*b*. In the preferred embodiment seat front cross member 6*b* is made from a solid metal rod of sufficient strength to hold seat section 6 in a rigid position when the present invention is used as a chair. When the present invention is used as a pack frame, seat front cross member 6*b* is pivoted back and may be fastened to back reinforcement member 4*b* by quick release hooks 20, or by any known conventional latching or mechanical connecting device. Other embodiments of the present invention may utilize flanges attached to seat front cross member 6*b* which will engage with a latch or latches built into back reinforcement member 4*b*, or any other mechanical fastening device.

Left leg retaining clip 22 and right leg retaining clip 24 are attached to left rear leg member 10*b* and right rear leg member 10*c* and clamp around left front leg member 8*b* and right front leg member 8*c*, respectively, when the invention is folded into the pack frame position, in order-to help hold the invention in a rigid, locked position for use as a packframe. The retaining clips may be made of any material such as plastic or metal that allows them to engage and disengage easily, to help hold the rear leg member 10 and the front leg member 8 together when the invention is in the packframe position.

As shown in FIG. 1 and FIG. 2, padded hipbelt 26 is attached to front leg cross member 8*a* and may be fastened around the user's waist to help support the weight of the present invention when used as a pack frame. A ventilated back pad 28 is attached to left front leg member 8*b* and right front leg member 8*c* and is designed to rest against the user's back when the invention is used as a packframe.

Any conventional pack with plurality of compartments may be attached to the back section 4, and backpack attachment fasteners 30*a*, 30*b*, 30*c*, 30*d*, 30*e* and 30*f* are attached to or built into back section 4. These attachment fasteners may be any metal or plastic fittings such as are commonly used on backpack frames to attach a backpack.

In an alternate embodiment, the combination packframe and chair may be constructed with no attached fasteners for the attachment of a backpack, and may be used as a chair which can be carried as a backpack but without any additional pack attached.

Figure 4:
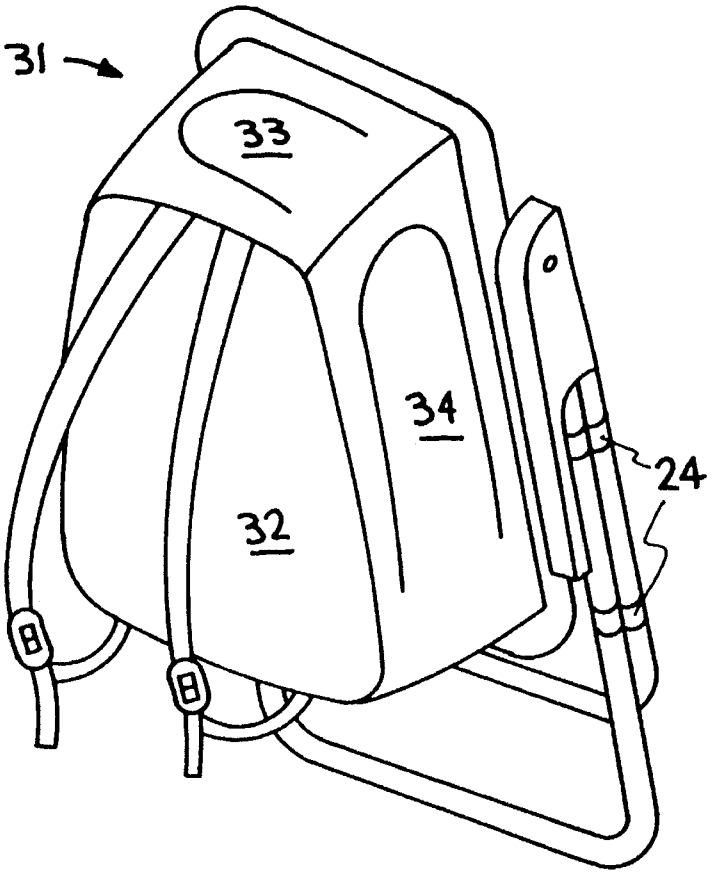
FIG. 4 is a second embodiment of the combination backpack and chair, shown in the pack position.

FIG. 4 shows a second embodiment of the combination backpack and chair, in the pack position. In this embodiment, a folding chair has a rigid backpack 31 attached to the back of the chair. Rigid pack 31 may be constructed of a rigid plastic or metal shell, or it may be made from a rigid frame covered with canvas or other fabric. When constructed as a rigid shell, one side of the backpack may also serve as the chair back, in place of a back section formed from a frame with a flexible panel attached to it. When the backpack is formed from a rigid frame covered with a flexible material, one side of the backpack may also serve as the back of the chair.

Rigid pack 31 is approximately 6 inches or more in width from front to back, and holds the chair approximately 6 inches or more away from the user's back so that no part of the chair will rub or bump against the user's body when the combination backpack and chair is being carried on a person's back.

A padded rigid panel 32 is designed to fit comfortably against the user's back when the combination backpack and chair is being used as a pack. Top access opening 33 and side access opening 34 allow easy access to the pack, and each opening may be fitted with zippered closure flaps or any other method of providing a secure closure for the openings may be used.

Left leg retaining clips 22 (shown in FIG. 5) and right leg retaining clips 24 are used to hold the combination pack and folding chair in the pack position when it is being carried as a backpack.

Figure 5:
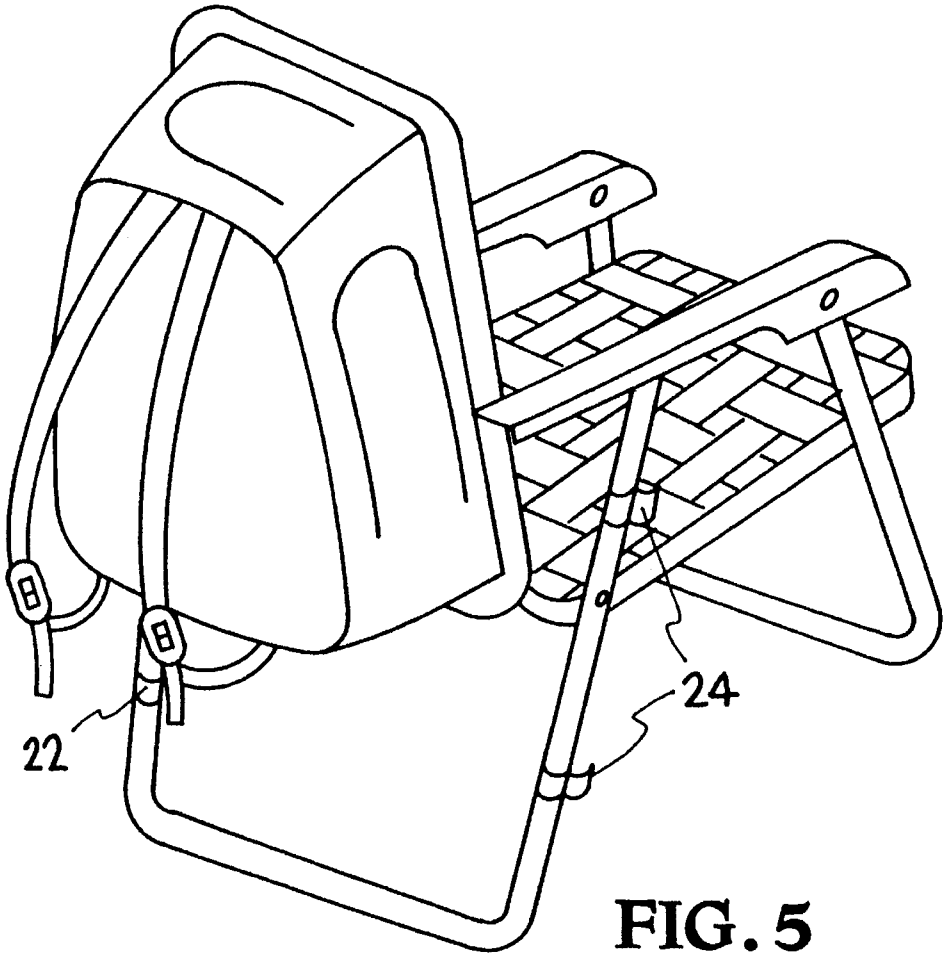
FIG. 5 is the second embodiment of the combination backpack and chair, shown in the chair position.

FIG. 5 shows the second embodiment in the chair position.

Figure 6:
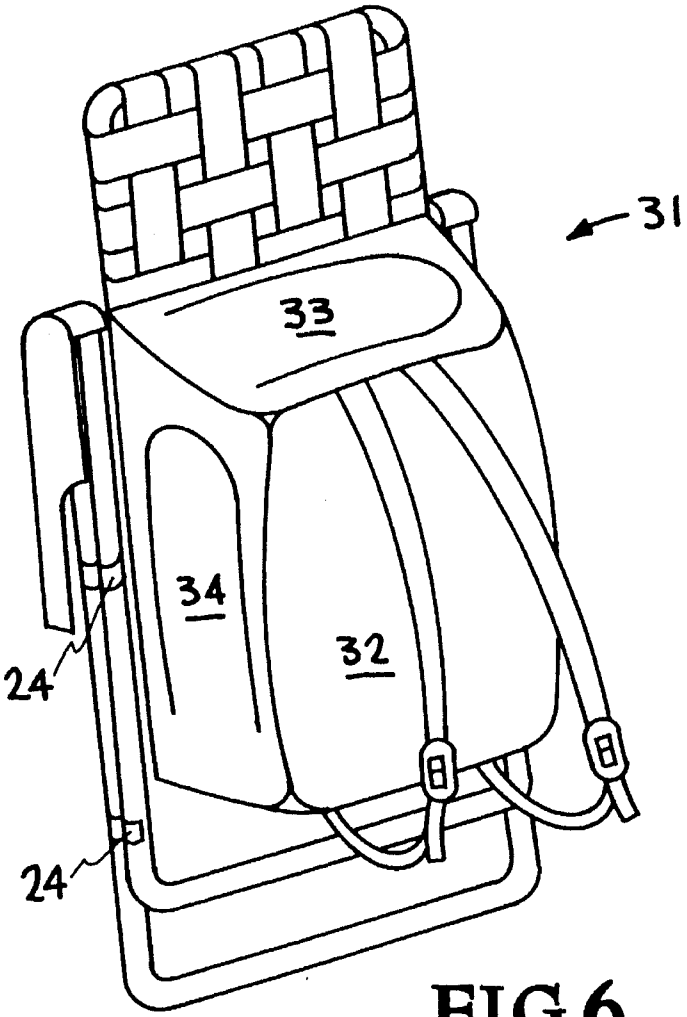
FIG. 6 is a third embodiment of the combination backpack and chair, shown in the pack position.

FIG. 6 shows a third embodiment of the combination backpack and chair, in the pack position. In this embodiment, a rigid pack 31 is attached to the underside of the seat of a folding chair. Rigid pack 31 may be constructed of a rigid plastic or metal shell, or it may be made from a rigid frame covered with canvas or other fabric. When constructed as a rigid shell, one side of the backpack may also serve as the chair seat, in place of a seat section formed from a frame with a flexible panel attached to it. When the backpack is formed from a rigid frame covered with a flexible material, one side of the backpack may also serve as the seat of the chair. As in the second embodiment, the rigid pack serves to hold the folding chair approximately six inches or more away from the back of the person carrying the combination pack and folding chair, so that no part of the folding chair will rub or bump against the person's body. Padded rigid panel 32 is designed to fit comfortably against the user's back. Top access opening 33 and side access opening 34 are shown. The combination pack and folding chair is held in the pack position by left leg retaining clips 22 (shown in FIG. 7) and right leg retaining clips 24.

Figure 7:
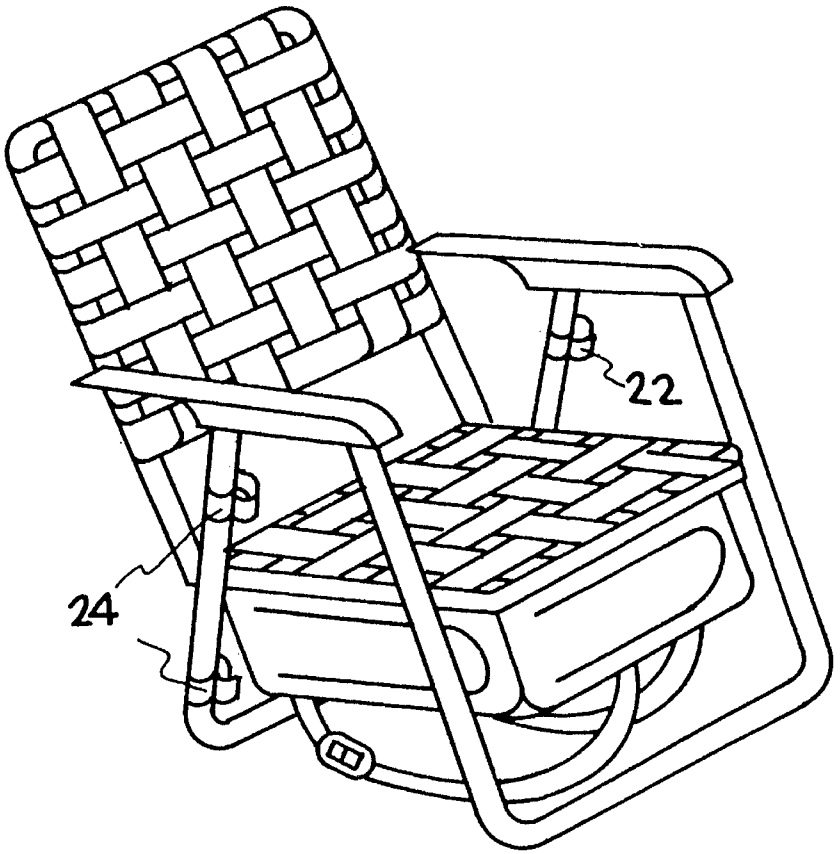
FIG. 7 the third embodiment of the combination backpack and chair, shown in the chair position.

FIG. 7 show the third embodiment in the chair position.

While the invention will be described in connection with a certain preferred embodiment it is to be understood that it is not intended to limit the invention to that particular embodiment. Rather, it is intended to cover all alternatives, modifications and equivalents as may be included within the spirit and scope of the invention as defined by the appended claims.

Operation—FIGS. 1, 2, and 3

The manner of changing the combination pack frame and folding chair, in its preferred embodiment, from one position to the other is as follows, starting with the invention in the pack frame position: Standing next to the pack frame the user holds the center of back top cross member 4*a* with one hand, and the center of seat front cross member 6*b* with the other hand. Seat front cross member 6*b* is released from the hooks holding it to back reinforcement member 4*b*. This is done by pushing seat front cross member 6*b* back and up to free it from quick release hooks 20. The user then unfolds the invention into the chair position, allowing seat front cross member 6*b* to swing or pivot into position below the plane of seat 6. To return the invention to the pack frame position, the user holds back top cross member 4*a* with one hand and seat front cross member 6*b* with the other hand, and folds seat 6 toward back 4, allowing seat front cross member 6*b* to pivot back until it is secured by the hooks attached to back reinforcement member 4*b*. The leg retaining clips are designed to release when the invention is unfolded from the packframe position, and to clamp the front and rear leg sections together when the invention is folded into the packframe position.

Operation—FIGS. 4, 5, 6 and 7

In the second and third embodiments, the combination pack and chair is held in the pack position by two retaining clips attached to each rear leg. When the chair is unfolded the clips release, and when the chair is folded the seat and back of the chair will be pushed together until the retaining clips on the rear legs clamp onto the front legs. In other embodiments, any other quick release latching devices may be used for the purpose of holding the combination pack and folding chair in the pack position.

Summary, Ramifications and Scope

The reader will see that the present invention can be conveniently used as a backpack or backpack frame and chair. It has the following additional advantages:

- it is comfortable for use both as a backpack or pack frame and as a chair;
- it is designed to be sturdy, lightweight and easily constructed;
- it is easily converted from pack frame to chair and back again to pack frame;
- it can be used to hold a pack upright for the convenience of the user when it is used as a chair;
- it can be used with a padded hipbelt and ventilated back pads for the comfort of the user when it is used as a pack frame;
- it is designed so that-cross members are curved to fit around the user's neck, shoulders, back and hips, to avoid the cross members rubbing against the user's neck, shoulders, back and hips;
- in its second and third embodiments, the combination pack and chair is designed so that a rigid pack holds the chair away from the user's body so that the chair cannot rub or bump against the user's body;
- it is designed to have commercial appeal because it looks like a comfortable pack frame when folded into the pack frame position.

Although the description above contains many specificities, these should not be construed as limiting the scope of the invention but as merely providing illustrations of some of the presently preferred embodiments of this invention. For example, the shoulder straps could be attached at different positions, or the clips that hold the leg members together when the invention is used as a pack frame could be designed differently, etc.

Thus the scope of the invention should be determined by the appended claims and their legal equivalents, rather than by the examples given.

I claim:

1. A combination pack frame and folding chair comprising:

(a) a folding chair with: a back section; a seat section pivotally connected to said back section, said seat section including a front cross member, left and right side members, and a rear cross member; and a front leg member and a rear leg member each pivotally connected to said seat section;

(b) shoulder straps attached to said folding chair, whereby said folding chair may be carried on a person's back;

wherein the improvement comprises: said front cross member of said seat section is curved or recessed on one side to form a concave or recessed surface on the side that faces toward the user's back when said combination pack frame and folding chair is carried on a person's back, whereby said front cross member of said seat section will not rub against the user's back when said combination pack frame and folding chair is carried on a person's back; and said front cross member of said seat section is pivotally connected to said left and right side members of said seat section, whereby said front cross member of said seat section will pivot to allow its concave or recessed surface to face upward when said combination pack frame and folding chair is being used as a chair, for the comfort of a person sitting in the chair.

2. The combination pack frame and folding chair of claim 1 wherein said seat section and said back section are generally rectangular and wherein the top and sides of said back section are formed from tubular metal, said left and right side members and said rear cross member of said seat section are formed from tubular metal, said front cross member of said seat section is formed from a metal rod, said back section and said seat section comprise fabric panels with means to attach said fabric panels to the sides of said back section and to said left and right side members of said seat section, said front and rear leg sections are u-shaped and each comprise a horizontal cross member, and wherein said shoulder straps are each attached at one end to said front cross member of said seat section and at the other end to either side of said rear leg section, and wherein said combination pack frame and folding chair further comprises: a left armrest and a right armrest, each pivotally connected to said back section and to one end of said front leg section and to one end of said rear leg section, a back reinforcement member of said back section, said back reinforcement member having means to hook or fasten to said front cross member of said seat section, a padded hip belt attached to said front leg section, and a ventilated back pad attached to said front leg section.

3. The combination pack frame and folding chair of claim 1 wherein said combination pack frame and folding chair comprises means to hook or fasten said front cross member of said seat section to a part of said back section when said combination pack frame and folding chair is in the pack frame position.

4. The combination pack frame and folding chair of claim 1 wherein a horizontal cross member of said back section is curved or recessed on one side to form a concave or recessed surface on the side that faces toward the user's body when said combination pack frame and folding chair is in the pack frame position.

5. The combination pack frame and folding chair of claim 1 wherein said front leg section comprises a horizontal cross member that is curved or recessed on one side to form a concave or recessed surface on the side that faces the user's body when said combination pack frame and folding chair is in the pack frame position.

6. The combination pack frame and folding chair of claim 1 wherein said rear leg section comprises a horizontal cross member that is curved or recessed on one side to form a concave or recessed surface on the side that faces the user's body when said combination pack frame and folding chair is in the pack frame position.

7. The combination pack frame and folding chair of claim 1 wherein said rear leg section is u-shaped and comprises a horizontal lower cross member which is curved or recessed sufficiently, and extends to the rear of said combination pack frame and folding chair sufficiently, to allow said combination pack frame and folding chair, when it is in the chair position, to support the weight of a loaded backpack of up to approximately 60 pounds when said backpack is attached to the rear side of said back section of said combination pack frame and folding chair.

8. The combination pack frame and folding chair of claim 1 wherein said back section has attached fasteners or other means for attaching a backpack.

9. The combination pack frame and folding chair of claim 1 wherein said combination pack frame and folding chair has retaining means to hold said rear leg section and said front leg section together when said combination pack frame and folding chair is in the pack frame position.

* * * * *